US012235077B2

(12) United States Patent
Hughes et al.

(10) Patent No.: US 12,235,077 B2
(45) Date of Patent: Feb. 25, 2025

(54) MAGAZINE ATTACHED ILLUMINATING DEVICE

(71) Applicant: NextLevel Training LLC, Ferndale, WA (US)

(72) Inventors: Michael Frank Hughes, Maple Falls, WA (US); Britton R Lentz, Everson, WA (US)

( * ) Notice: Subject to any disclaimer, the term of this patent is extended or adjusted under 35 U.S.C. 154(b) by 0 days.

(21) Appl. No.: 17/976,972

(22) Filed: Oct. 31, 2022

(65) Prior Publication Data

US 2023/0134871 A1 May 4, 2023

Related U.S. Application Data

(60) Provisional application No. 63/274,030, filed on Nov. 1, 2021.

(51) Int. Cl.

| | |
|---|---|
| ***F41G 1/35*** | (2006.01) |
| ***F41A 9/64*** | (2006.01) |
| ***F41G 11/00*** | (2006.01) |

(52) U.S. Cl.

CPC ..... *F41G 11/001* (2013.01); *F41A 9/64* (2013.01); *F41G 1/35* (2013.01)

(58) Field of Classification Search

CPC ... F41G 1/32; F41G 1/34; F41G 1/345; F41G 1/35

See application file for complete search history.

(56) References Cited

U.S. PATENT DOCUMENTS

| | | | | | |
|---|---|---|---|---|---|
| 784,227 | A * | 3/1905 | Riblet | F41G 1/35 | 362/114 |
| 976,416 | A * | 11/1910 | Weber | F41G 1/35 | 362/110 |
| 1,070,883 | A * | 8/1913 | Forrester | F41G 1/35 | 362/114 |
| 1,263,667 | A * | 4/1918 | Henderson et al. | F41G 1/35 | 362/114 |
| 1,427,042 | A * | 8/1922 | Wetmore | F41G 1/35 | 362/187 |

(Continued)

FOREIGN PATENT DOCUMENTS

WO WO-0077470 A1 * 12/2000 ..... F41G 1/35

OTHER PUBLICATIONS

Streamlight Scorpion LED Flashlight, known in 1997 reference, US. Patriot, https://www.uspatriottactical.com/streamlight-scorpion-led-flashlight-nsn-6230-01-556-0434.*

*Primary Examiner* — Derrick R Morgan
(74) *Attorney, Agent, or Firm* — Michael Hughes

(57) ABSTRACT

A device includes a prime illuminator to throw light on an object. The prime illuminator defines a center of throw of the light, and luminescent dispersion from the light. The device is configured to be attached to a bottom of a magazine. The magazine with the device is configured to be inserted in a magazine insert of a firearm. The center throw of light from the prime illuminator is configured to be vertically lower from a bore axis that extends longitudinally through a geometric center of a muzzle of the firearm. Further, the luminescent dispersion from the prime illuminator is configured to be pointing towards the object, and the muzzle of the firearm is configured to be directed away from the object, when the firearm is configured to be raised in a high ready position or in a compressed high ready position.

9 Claims, 8 Drawing Sheets

(56) References Cited

U.S. PATENT DOCUMENTS 2,101,479 A * 12/1937 Schenk ..... F41G 1/35 362/184
2,912,566 A * 11/1959 Cornett ..... F21V 33/00 362/110
5,040,885 A * 8/1991 Simms ..... G02B 27/34 359/399
5,064,988 A * 11/1991 E'nama ..... F41G 1/35 42/117
5,167,446 A * 12/1992 Haroutunian ..... F41G 1/35 362/110
5,177,309 A * 1/1993 Willoughby ..... F41G 1/35 362/110
5,359,779 A * 11/1994 Polk ..... F41G 1/35 362/184
5,557,872 A * 9/1996 Langner ..... F41C 23/22 42/117
5,560,703 A * 10/1996 Capps, III ..... F41G 1/35 362/110
5,590,486 A * 1/1997 Moore ..... F41G 1/35 42/114
5,628,555 A * 5/1997 Sharrah ..... F41G 1/34 362/114
5,784,823 A * 7/1998 Chen ..... F41G 11/001 362/110
5,816,683 A * 10/1998 Christiansen ..... F41C 27/00 362/110
6,023,875 A * 2/2000 Fell ..... F41C 27/00 42/146
7,108,390 B2 * 9/2006 Lawless ..... F41G 1/35 362/110
7,117,622 B2 * 10/2006 Freed ..... F41A 9/65 42/71.02
7,934,333 B1 * 5/2011 Tuz ..... F41G 1/35 42/96
8,459,822 B1 * 6/2013 Lambert ..... F41G 1/473 42/114
9,057,585 B1 * 6/2015 Veldman ..... F41G 1/35
10,344,959 B2 * 7/2019 Worman ..... F21V 19/0035
10,852,086 B1 * 12/2020 Hillis ..... F41A 9/71
11,085,717 B1 * 8/2021 Hillis ..... F41A 9/71
11,168,954 B1 * 11/2021 Spykerman ..... F41A 9/71
11,578,945 B1 * 2/2023 Rosenbaum ..... F41G 1/35
11,592,256 B2 * 2/2023 Hughes ..... F41A 9/61
11,644,257 B1 * 5/2023 Roe ..... F41A 9/71 42/6
2002/0029506 A1 * 3/2002 Wollmann ..... F41A 9/71 42/50
2002/0172034 A1 * 11/2002 Lawless ..... F41G 11/001 362/205
2005/0011097 A1 * 1/2005 Freed ..... F41A 9/65 42/49.02
2006/0010751 A1 * 1/2006 Shear ..... F41C 27/00 42/71.02
2009/0009987 A1 * 1/2009 Graham ..... F41G 11/001 434/21
2009/0122527 A1 * 5/2009 Galli ..... F41G 11/003 362/110
2013/0235562 A1 * 9/2013 Chauvie ..... F41G 1/35 362/110
2014/0190063 A1 * 7/2014 Lau ..... F41G 1/35 42/146
2015/0198417 A1 * 7/2015 Werner ..... F41G 1/35 250/493.1
2016/0047624 A1 * 2/2016 Hancosky ..... F41G 11/001 42/113
2017/0184359 A1 * 6/2017 Porat ..... F41A 9/65
2018/0058805 A1 * 3/2018 Mock ..... F41G 1/35
2019/0093986 A1 * 3/2019 Gray ..... F41G 1/35
2019/0154243 A1 * 5/2019 Worman ..... F21V 19/004
2019/0301835 A1 * 10/2019 Tayon ..... F41G 11/003
2020/0208929 A1 * 7/2020 Corso ..... F41A 9/71
2020/0240750 A1 * 7/2020 Reed ..... F21V 23/0414
2021/0372733 A1 * 12/2021 Hall ..... F41A 3/66
2023/0228508 A1 * 7/2023 Ye ..... F41A 9/65 42/49.02

* cited by examiner

MAGAZINE ATTACHED ILLUMINATING DEVICE

CROSS REFERENCE TO RELATED APPLICATIONS

The present invention claims priority under 35 U.S. Code, Section 119 on the provisional application No. 63/274,030 filed on Nov. 1, 2021, the disclosures of which are incorporated by reference.

BACKGROUND

Technical Field of the Invention

Present invention relates to illuminating devices in firearms, and, more particularly, to a magazine attached illuminating device.

Related Prior Arts

Illuminating devices or flashlight devices generally used with firearms (weapons mounted light) for aligning a flashlight beam relative to a line of sight of the firearms or tool when pointing toward a target, so that the beam and line of sight intersect at a predetermined range.

However, it has long been hazarding in peril for the weapons mounted light to force the end-user to point the muzzle of the firearm exactly where they are illuminating. With conventional lights that are weapon mounted and substantially centered with the muzzle center access bore, it is impossible to identify a target and then point the muzzle at a potential target.

Further, such flashlight systems may not be effective and even be dangerous where law enforcement, home security or any end user are not aiming or willing to point the firearm to innocent people or other objects to destroy or shoot.

Therefore, there exists a need for an illuminating device or a magazine attached illuminating device that is operatively configured to fit within the firearm, where the light from the illuminating device is pointed towards the object or towards the innocent people, whereby making it conducive to position of the firearm in a compressed high ready position where otherwise having the muzzle pointed upward with a lower probability of "muzzling" or otherwise pointing the firearm that innocent people or other objects the end-user is not willing to destroy or shoot.

SUMMARY

In view of the above objects, in one aspect, a magazine attached illuminating device for a firearm having a magazine is provided. The magazine attached illuminating device may include a prime illuminator to throw light on an object. The prime illuminator defines a center of throw of the light, and luminescent dispersion from the light. The magazine attached illuminating device is configured to be attached to a bottom of the magazine. The magazine with the magazine attached illuminating device is configured to be inserted in a magazine insert of the firearm. The center throw of light from the prime illuminator is configured to be vertically lower from a bore axis that extends longitudinally through a geometric center of a muzzle of the firearm.

Further, the luminescent dispersion from the prime illuminator is configured to be pointing towards the object, and the muzzle of the firearm is configured to be directed away from the object, when the firearm is configured to be raised in a high ready position or in a compressed high ready position.

The throw of light may be between 30° to 160° in a lateral direction and approximately the same as in a vertical direction, and more preferably, between 90° and 120° in the lateral and vertical directions.

In further aspect, a magazine attached illuminating device for a firearm having a magazine is provided. The magazine attached illuminating device includes an illuminating device body, a prime illuminator, a switch member and a power source. The illuminating device body is configured to be attached on a bottom of the magazine. The prime illuminator is attached to a front end of the illuminating device body to throw light on an object. The prime illuminator defines a center of throw of the light, and luminescent dispersion from the light. The switch member is attached to a rear end, opposite to the front end, of the illuminating device body to turn the magazine attached illuminating device on and off. The power source is provided in the illuminating device body to power the prime illuminator, upon actuation of the switch member. A center throw of light from the prime illuminator is configured to be vertically lower from a bore axis extending longitudinally through a geometric center of a muzzle of the firearm. the luminescent dispersion from the prime illuminator is configured to be pointing towards the object and the muzzle of the firearm is configured to be directed away from the object, when the firearm is configured to be raised in a high ready position or in a compressed high ready position.

In an embodiment, the illuminating device body includes an attaching arrangement, a base region and an attaching cap. The attaching arrangement is provided to detachably attach the magazine attached illuminating device to the bottom of the magazine. The base region is provided to be rounded and configured to not be extended very far from a lower edge of the firearm to have a compressed and rounded corner. The attaching cap is provided to be detachably coupled to the illuminating device body.

In an embodiment, the prime illuminator includes Light Emitting Diodes (LED). The prime illuminator protrudes outwards from the illuminating device body, and is angled with respect to the illuminating device body. The throw of light of the prime illuminator may be between 30° to 160° in a lateral direction and approximately the same as in a vertical direction, and more preferably, between 90° and 120° in the lateral and vertical directions.

In an embodiment, the switch member includes a switch, and a ridge coupled to the switch and operatively engages with the power source via a power circuit. In one arrangement, the switch is a sliding switch to be slid vertically downward and vertically upward to move the ridge. The ridge is moved forward when the sliding switch is slid vertically upward to close the power circuit with the power source to turn on the prime illuminator. Further, the ridge is moved backward when the sliding switch is slid vertically downward to disengage the power circuit with the power source to turn on the prime illuminator. In one another arrangement, the switch is a pivoting switch to be rotated to a first orientation and to a second orientation to move the ridge. The rotation enables the ridge to move forward to close the power circuit with the power source to turn on the prime illuminator, and to move backward to disengage the power circuit with the power source to turn on the prime illuminator.

In one further aspect, a magazine for a firearm is provided. The magazine includes a magazine attached illuminating device attached on a bottom of the magazine. The magazine attached illuminating device includes a prime illuminator to throw the light on an object. The prime illuminator defines a center of throw of the light, and luminescent dispersion from the light. The center throw of the light from the prime illuminator is configured to be vertically lower from a bore axis that extends longitudinally through a geometric center of a muzzle of the firearm. The luminescent dispersion from the prime illuminator is configured to be pointing towards an object and the muzzle of the firearm is configured to be directed away from the object, when the firearm is configured to be raised in a high ready position or in a compressed high ready position.

The magazine includes a magazine body whereby the magazine attached illuminating device is retrofitted. The magazine body may include bullet slots configured to receive bullets. The magazine attached illuminating device is attached on the bottom of the magazine body by replacing a conventional base plate of the magazine, and wherein a base region of the magazine attached illuminating device is rounded and configured to not be extended very far from a lower edge of the firearm to have a compressed and rounded corner.

The magazine body may be without bullet slots wherein the magazine is attached illuminating device is attached on the bottom to be used as flashlight, and wherein a base region of the magazine attached illuminating device is rounded and configured to not be extended very far from a lower edge of the firearm to have a compressed and rounded corner.

In one further aspect, a firearm includes a magazine to be received in a magazine slot; and a magazine attached illuminating device attached on a bottom of the magazine. The magazine attached illuminating device includes a prime illuminator to throw the light on an object, wherein the prime illuminator defines a center of throw of the light, and luminescent dispersion from the light. The center throw of the light from the prime illuminator is configured to be vertically lower from a bore axis that extends longitudinally through a geometric center of a muzzle of the firearm. Further, the luminescent dispersion from the prime illuminator is configured to be pointing towards an object and the muzzle of the firearm is configured to be directed away from the object, when the firearm is configured to be raised in a high ready position or in a compressed high ready position. The throw of light may be between 30° to 160° in a lateral direction and approximately the same as in a vertical direction, and more preferably, between 90° and 120° in the lateral and vertical directions.

This together with the other aspects of the present invention, along with the various features of novelty that characterize the present invention, is pointed out with particularity in the claims annexed hereto and forms a part of the present invention. For a better understanding of the present invention, its operating advantages, and the specified object attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

DESCRIPTION OF THE PREFERRED EMBODIMENTS

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The terms, "a" and "an" herein do not denote a limitation of quantity, but rather denote the presence of at least one of the referenced items.

Figure 1A:
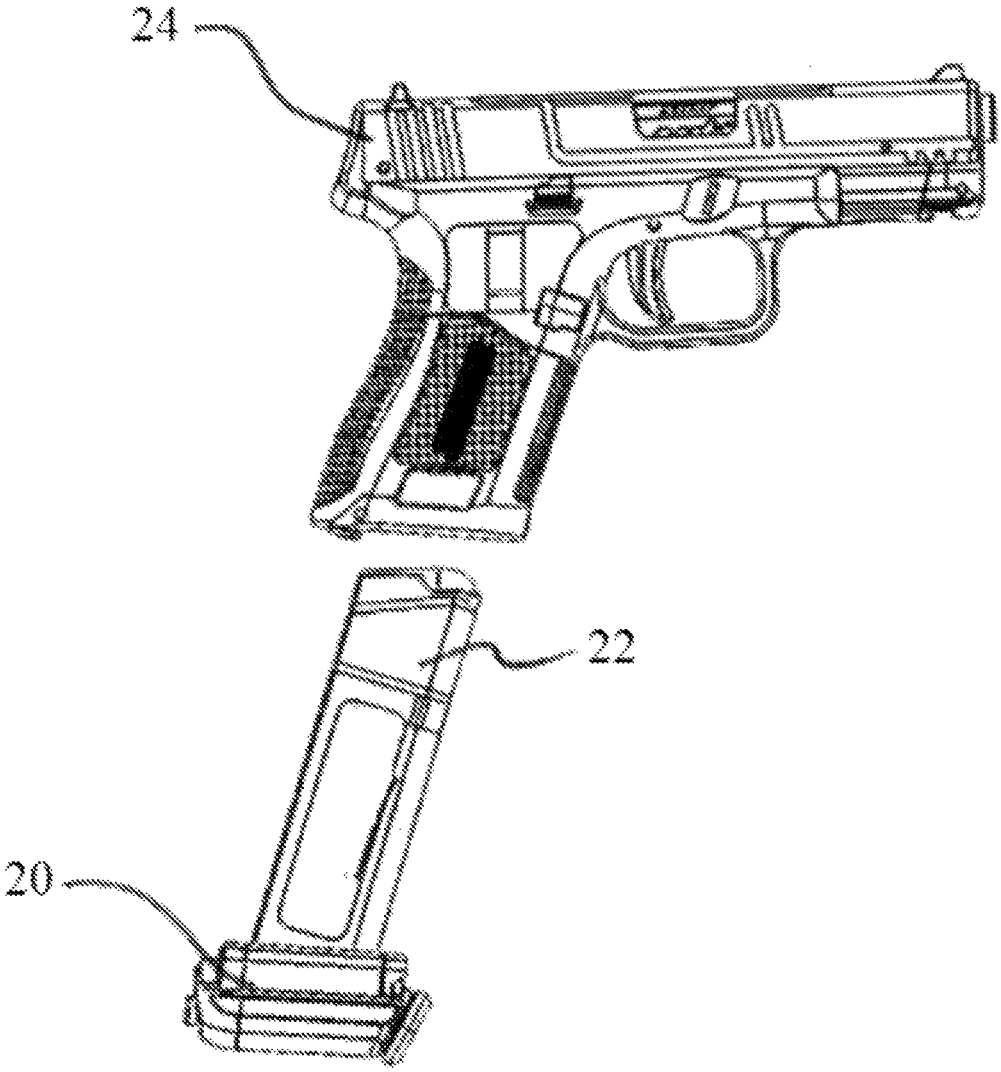
FIGS. 1A and 1B illustrate a side view and a side perspective view of a firearm and a magazine attached illuminating device attached to a magazine to be inserted in the firearm, in accordance with an exemplary embodiment of the present disclosure.
Figure 1B:
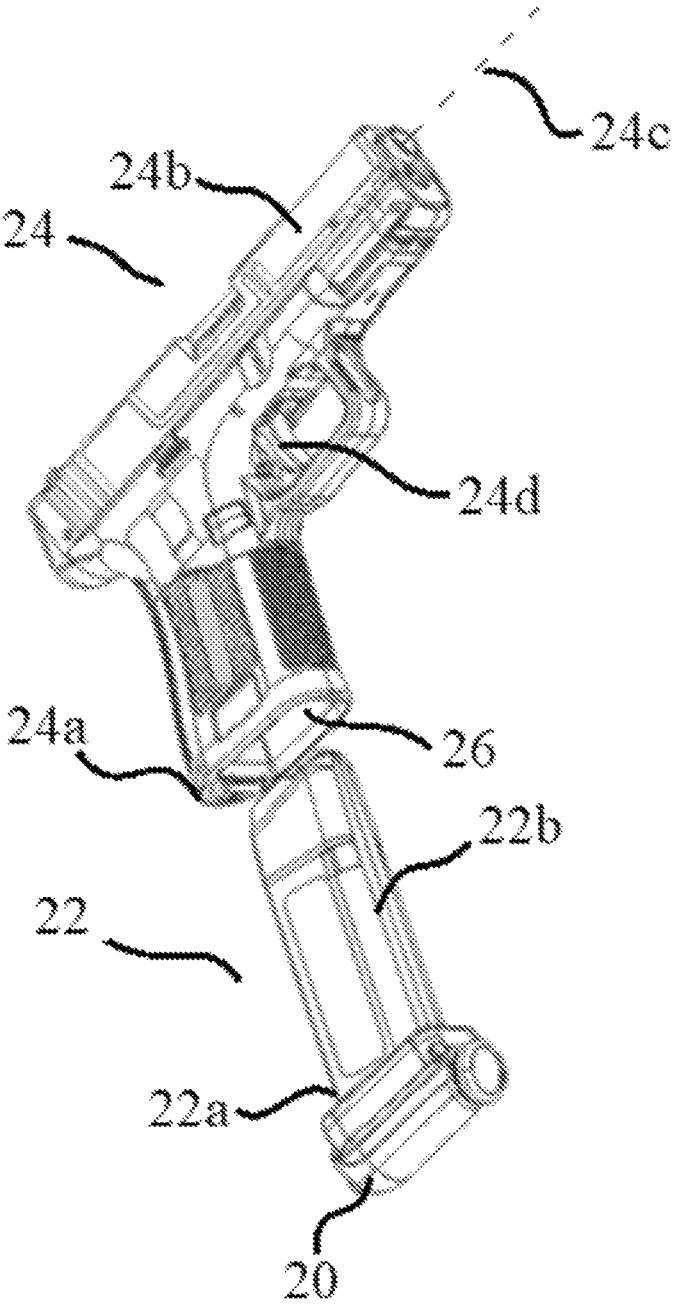
Figure 2A:
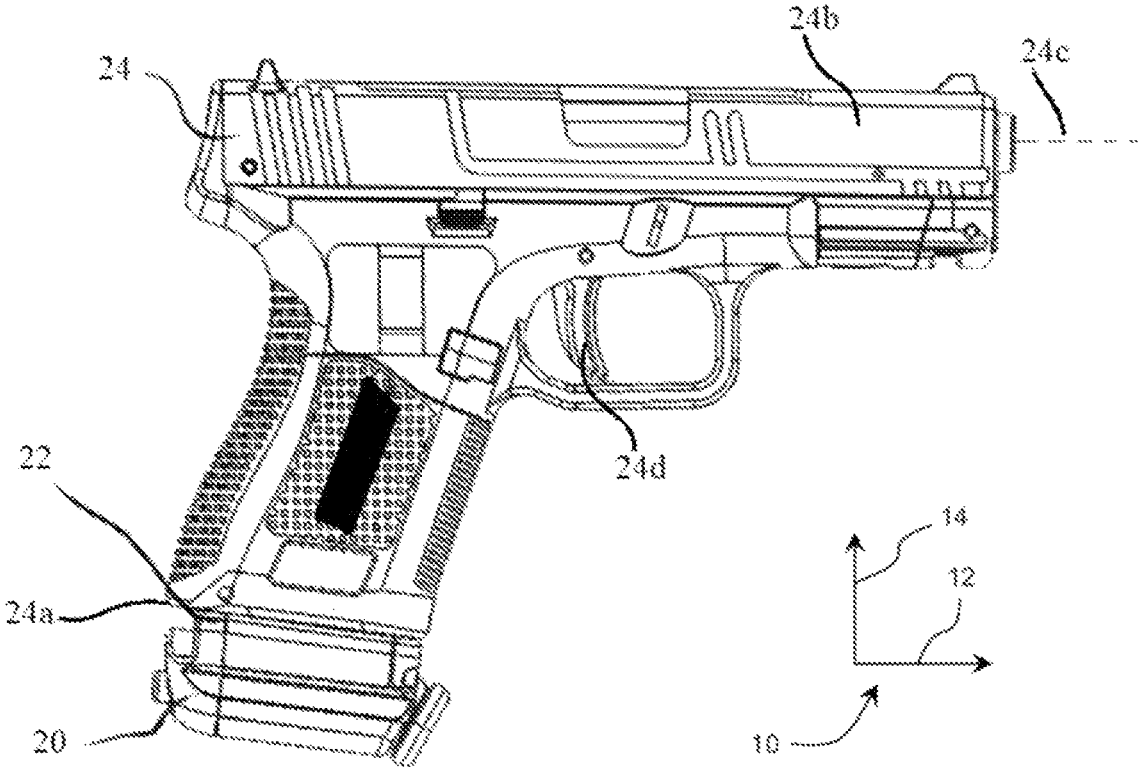
FIGS. 2A and 2B, respectively, illustrate side and front views of the firearm and the magazine with the magazine attached illuminating device inserted in the firearm, in accordance with an exemplary embodiment of the present disclosure.
Figure 2B:
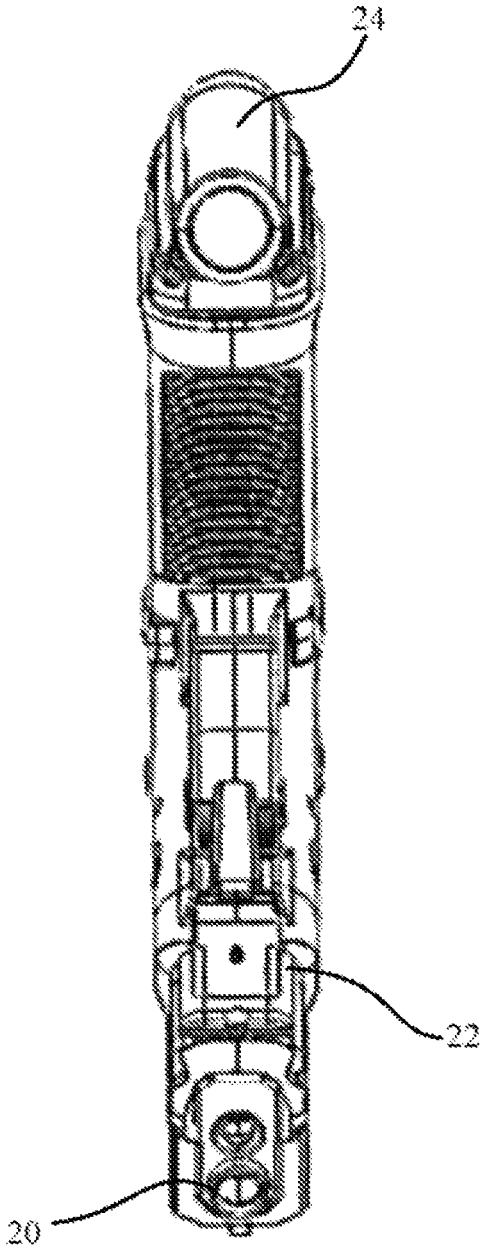

Referring to FIGS. 1A and 1B, there are shown a magazine attached illuminating device 20 operatively configured to be attached with a magazine 22 to be inserted in a firearm 24, in accordance with an exemplary embodiment of the present disclosure. Further, as can be seen in FIGS. 2A and 2B, the magazine attached illuminating device 20 operatively attached with the magazine 22 is inserted in a magazine insert cavity 26 of the firearm 24. The firearm 20 generally defined and orientated by way of referencing an axis system 10, as shown in the forward portion of FIG. 2A. The axis system 10, as shown, is used to generally orientate and describe the components of the firearm 20 with respect to one another without being necessarily confined to one particular orientation. The axis system 10 has a longitudinal axis 12, where the arrow of the longitudinal axis 12 points in a longitudinally forward direction and the diametrically opposed direction is generally referred to as a longitudinally rearward direction. The axis system 10 also includes a vertical axis 14 that is generally aligned in what is referred to as a "vertical direction" or otherwise referred to as an upper direction. As further shown in FIG. 1, an axis substantially orthogonal to the longitudinal axis 12 and to the vertical axis 14 is defined as a lateral axis indicating a lateral direction. As further described herein, components of the firearm 20 may rotate about a "lateral axis" meaning any lateral axis on the firearm 20 which can define lateral rotation. Again, such orientations and rotations are not absolute and for example could be degrees off in any of the other orthogonal directions but generally denote a direction to aid the description of the disclosure.

Referring now to FIGS. 3A-3C, 4A-4C and 5A-5C to describe the magazine attached illuminating device 20. The magazine attached illuminating device 20 may include an illuminating device body 28, a prime illuminator 30, a switch member 32 and a power source 34. The illuminating device body 28 may be configured to be attached on a bottom 22*a* of the magazine 22. The prime illuminator 30 may be attached to a front end 28*a* of the illuminating device body 28 to throw light on an object, wherein such throw of light defines its center, referred to as a "center throw of light" as shown in FIG. 6 by numeral 36, and the light from the prime illuminator 30 also defines the luminescent dispersion that is directed towards the object, and shown in FIG. 6 by numeral 38. Further, the switch member 32 is attached to a rear end 28*b*, opposite to the front end 28*a*, of the illuminating device body 28 to turn the magazine attached illuminating device 20 on and off. The power source 34 is provided in the illuminating device body 28 to power the prime illuminator 26, upon actuation of the switch member 30. In one arrangement, the power source 34 may be provided in the illuminating device body 28 between the prime illuminator 26 and the switch member 28.

Figure 3A:
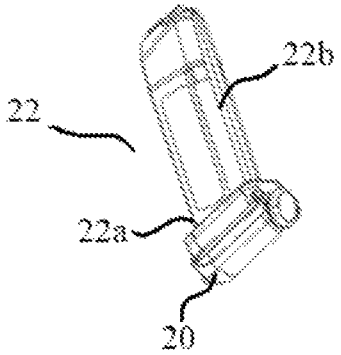
FIG. 3A illustrates a magazine attached illuminating device attached to a magazine, in accordance with an exemplary embodiment of the present disclosure.
Figure 3B:
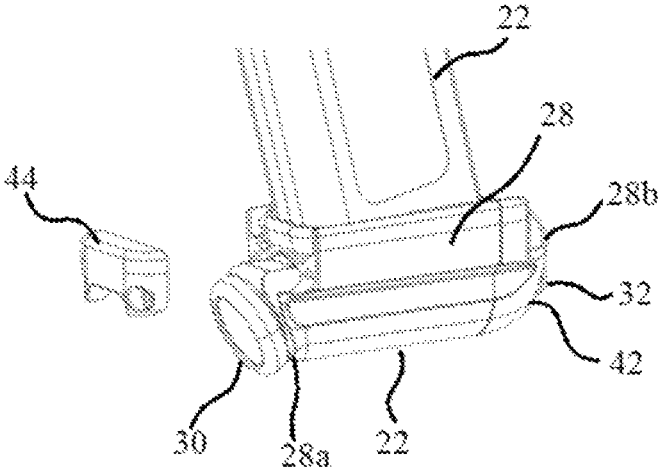
FIG. 3B illustrates an enlarged view of the magazine attached illuminating device attached to a magazine, in accordance with an exemplary embodiment of the present disclosure.
Figure 3C:
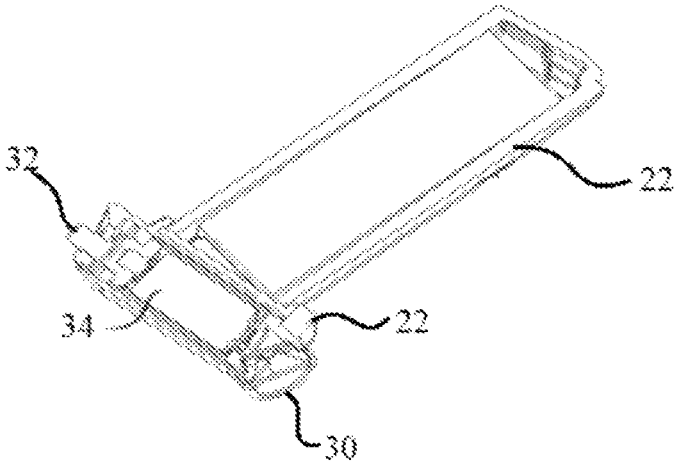
FIG. 3C illustrates a cross-sectional view of the magazine attached illuminating device attached to a magazine, in accordance with an exemplary embodiment of the present disclosure.
Figure 4A:
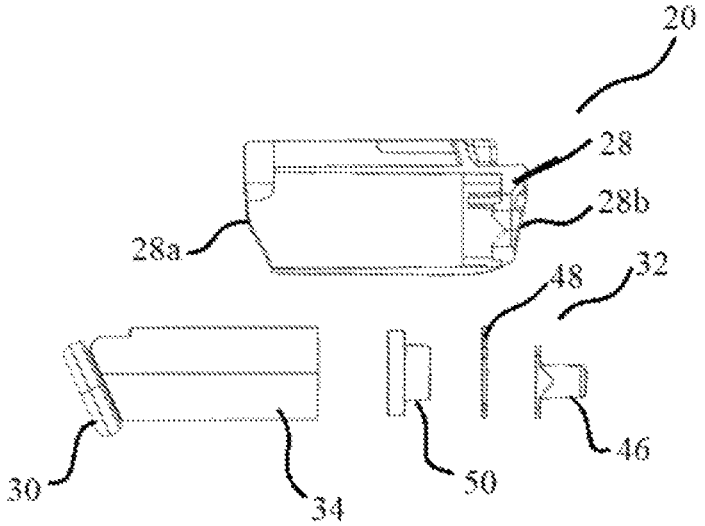
FIGS. 4A-4C illustrate disassembled view of a magazine attached illuminating device, in accordance with an exemplary embodiment of the present disclosure.
Figure 4B:
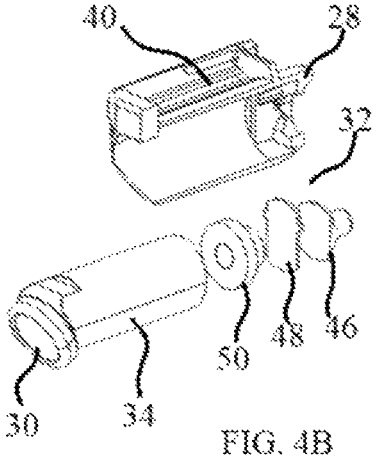
Figure 4C:
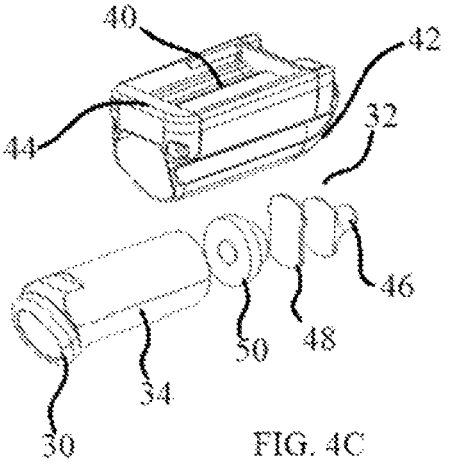

The magazine attached illuminating device 20 is operatively configured to fit on the magazine 22, as shown in FIG. 1A, and also seen in FIGS. 3A-3C. The magazine 22 is configured to fit within the firearm 24, as shown in FIGS. 2A and 2B, and FIG. 6. The magazine 22 may include a magazine body 22*b*, whereby the magazine attached illuminating device 20 may be retrofitted. In one embodiment, the magazine 22 may be a conventional design readily available in the market where the magazine attached illuminating device 20 is configured to fit there on the bottom 22*a* of the magazine body 22*b* by replacing the conventional base plate. In one embodiment, the illuminating device body 28 may include an attaching arrangement 40 to detachably attach the magazine attached illuminating device 20 to the bottom 22*a* of the magazine 22. The illuminating device body 28 may also include a base region 42, which may be rounded and configured to not be extended very far from a lower edge 24*a* of the firearm 24 to have a compressed and rounded corner. The particularly advantageous of such design of the lower edge 24*a* of the firearm 24 is to have a compressed and rounded corner area that does not "print" in plain clothes in particular when the end-user is carrying the entire assembly 1 including the firearm 24, the magazine 22 and the magazine attached illuminating device 20 on their body, such as along an appendix carry.

The illuminating device body 28 may also include an attaching cap 44 to be detachably coupled to the illuminating device body 28.

In one form, the magazine body 22*a* of the magazine 22 may include bullet slots configured to receive bullets, such as a conventional magazine. The magazine body 22*a* of the magazine 22 may also be without bullet slots, and when such magazine 22 includes the magazine attached illuminating device 20, the overall assembly may be used by an end-user as a flashlight.

Further, the magazine attached illuminating device 20 has and LED which functions as the prime illuminator 30. Of course, in other forms the prime illuminator 30 may be standard incandescent but LED technology has particular advantages of providing higher number of lumens and less heat production. The prime illuminator 30 protrudes outwards from the illuminating device body 28, and may be angled with respect to the illuminating device body 28, as seen in FIGS. 2A and 2B.

The power source 28 may be a conventional battery such as a CR2 lithium battery. Further, the switch member 32 may include a switch 46, and a ridge 48 coupled to the switch 46 and operatively engages with the power source 34 via a power circuit 50 to turn the magazine attached illuminating device 20 on and off. In one embodiment, the switch 46 may be a sliding switch, as seen in FIGS. 5A and 5B, and in another embodiment, the switch 46 may be a pivoting switch, as seen in FIG. 5C.

Figure 5A:
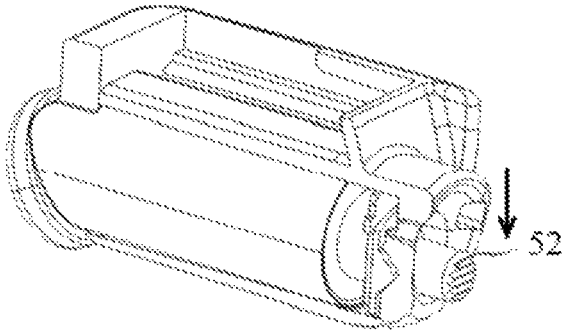
FIGS. 5A and 5B illustrate perspective views of a magazine attached illuminating device depicting a switching arrangement, in accordance with one exemplary embodiment of the present disclosure.
Figure 5B:
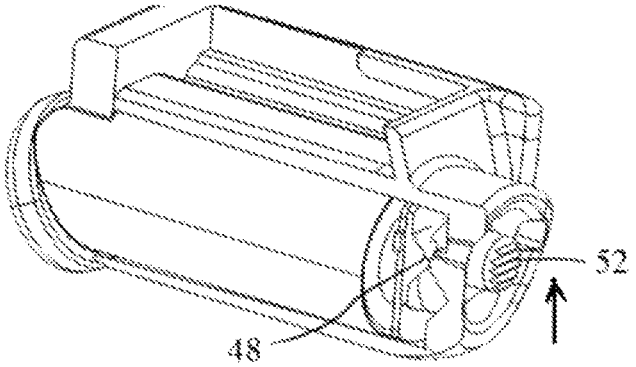
Figure 5C:
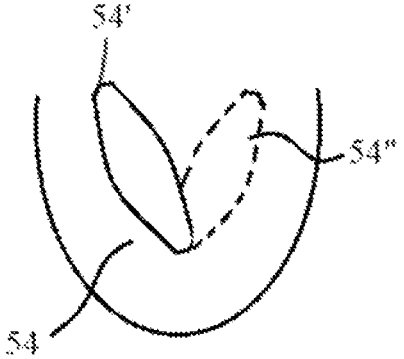
FIG. 5C illustrates a switching arrangement, in accordance with second exemplary embodiment of the present disclosure.
Figure 6:
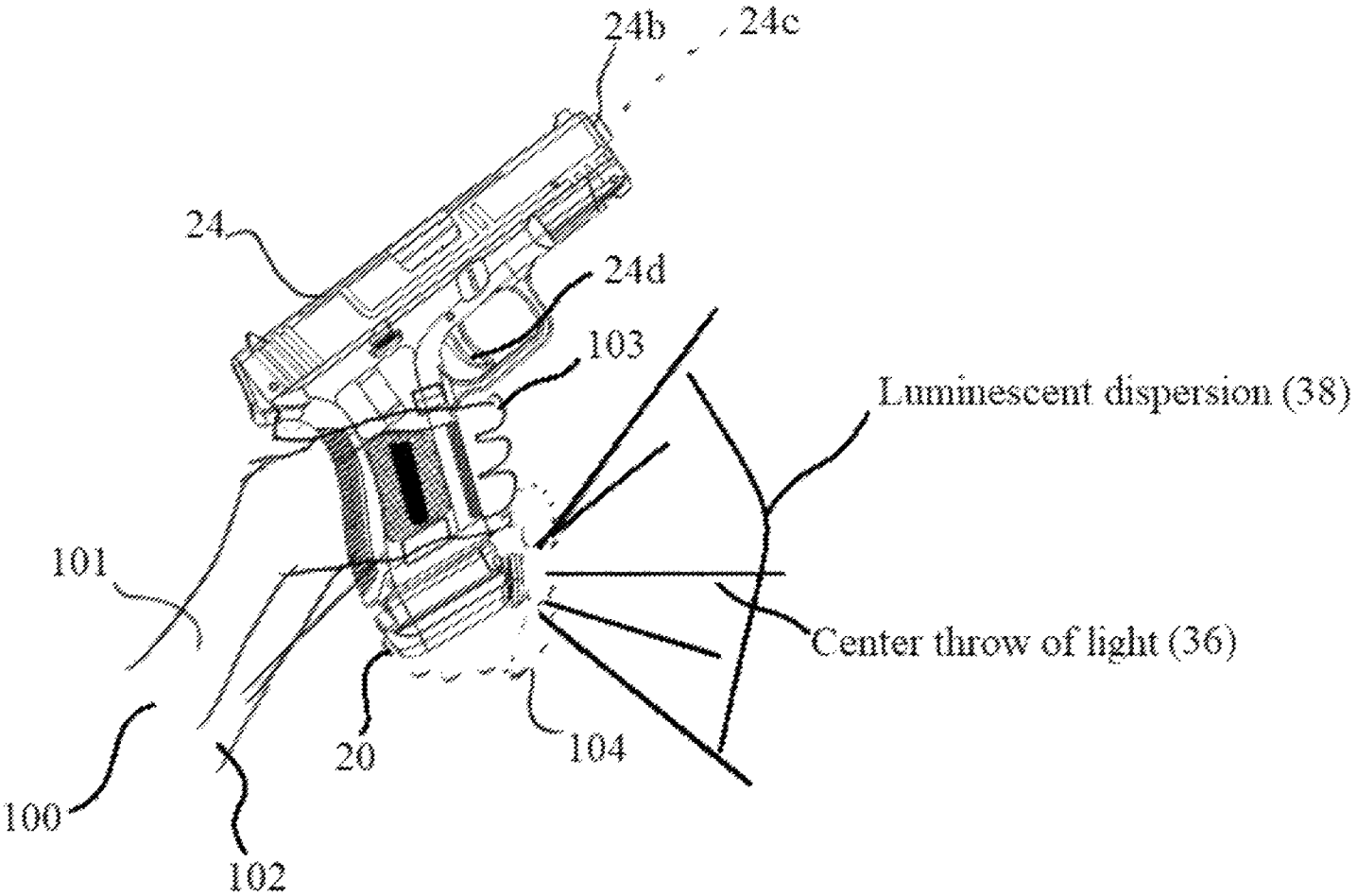
FIG. 6 illustrates a firearm and a magazine with a magazine attached illuminating device used by an end-user, in accordance with an exemplary embodiment of the present disclosure.

As shown in FIGS. 5A and 5B, where the switch 46 is the sliding switch and indicated by numeral 52. In such embodiment, the switch 52 may be slid vertically downward, as shown in FIG. 5A, and may be slid vertically upward, as shown in FIG. 5B. Such sliding action may enable pressing of the ridge 48 to turn the prime illuminator 30 'ON' and 'OFF'. For example, the ridge 48 may be moved forward when the sliding switch 52 is slid vertically upward to close the power circuit 50 with the power source 34 to turn 'ON' the prime illuminator 30. Further, the ridge 48 may be moved backward when the sliding switch 52 is slid vertically downward to disengage the power circuit 50 with the power source 34 to turn on the prime illuminator 30. Further, as shown in FIG. 5C, in another embodiment, the switch member 32 is the pivoting switch, as indicated by numeral 54, to be rotated to a first orientation and to a second orientation to move the ridge 48. The pivoting switch 54 may pivot from a first orientation, shown at 54', to a second orientation, shown at 54", whereby the rotation thereof has a similar bias in action as shown in FIGS. 5A and 5B to move the ridge 48 forward and backward to turn the prime illuminator 30 'ON' and 'OFF'. For example, the rotation of the pivoting switch 54 enables the ridge 48 to move forward to close the power circuit 50 with the power source to turn 'ON' the prime illuminator 30, and to move backward to disengage the power circuit 50 with the power source 34 to turn 'OFF' the prime illuminator 30.

Referring now to FIG. 6, the end-user, as depicted by numeral 100, may be grasping the firearm 24 in a high ready position or a compressed high ready position. In such orientation, a muzzle 24*b* of the firearm 24 is pointed upward presumably away from potential liabilities, such as innocent people but note the luminescent dispersion generally indicated at 38 allows for the front portion in front of the end-user 100 to be illuminated. It has long been hazarding in peril for weapons mounted light to force the end-user 100 to point the muzzle 24*b* exactly where they are illuminating.

With conventional lights that are weapon mounted and substantially centered with an extended bore-axis 24*c* of the muzzle 24*b*, it is impossible to identify a target and then point the muzzle 24*b* at a potential target. The current magazine attached illuminating device 20 last for clearing and search in a room in the orientation as shown in FIG. 6.

Further, what is also disclosed is a method of illuminating an area in front of the firearm 24 which is handled by an end-user 100, and described in conjunction with FIG. 6. The magazine attached illumination device 20 is attached to the magazine 22 and the magazine 22 is operatively configured to fit within the magazine insert cavity 26 of the firearm 24, such as a pistol. The prime illuminator 30 at the front end of the illuminating device body 28 throws light on an object, wherein the center throw of light, as depicted by numeral 36, is vertically lower from the extended bore axis 24*c* that extends longitudinally through a geometric center of a muzzle 24*b* of the firearm 24, whereby making it conducive to position the firearm 24 in a compressed high ready position where otherwise having the muzzle 24*b* pointed upward with a lower probability of "muzzling" or otherwise pointing the firearm 24 that innocent people or other objects the end-user 100 is not willing to destroy or shoot. Further, the end-user 100 has a strong hand 101 and a support hand 102 where the strong hand 101 may be grasping the firearm 24 and has a trigger finger 103 which is designated to pull the trigger 24*d* of the firearm 24. The support hand 102 generally covers around the strong hand 101. The support hand 102 may be effectively operate to turn 'ON' and 'OFF' the prime illuminator 30 by covering the prime illuminator 30 with the support hand 102. As shown by the hatched line 104 in FIG. 6, the support hand 102 may be slide down or lay and cover the prime illuminator 30 whereby quickly turning it 'OFF'. This can be tactically very important for an end-user 100 who does not want to disclose their location, but rather, temporarily and quickly turn 'OFF' the prime illuminator 30 by simply covering the front portion of the prime illuminator 30 whereby the photons from the LED are absorbed by the palm area of the hand. If the light from the prime illuminator 30 is too bright and actually will illuminate red glow therefore in the most desirable form the light is of correct luminosity to be bright enough to illuminate a room, such as 15 yards out a very broad wide exposure to physically and psychologically allow the end-user 100 to open their eyes, vision and awareness to possible threats in the darkness. Further, the because the light from the prime illuminator 30 may be covered with the support hand 102 very quickly it should not be burnt if the LED is too hot by being too powerful and drawing too much energy from the power source 34.

A mentioned above, the disclosure has an 'ON' and 'OFF' switch, such as the switch 46, in the rear end 28*b* and then one method of using the illumination technique is that if the end-user 100 has a first and second illumination devices, one on a magazine 22 in the firearm 24, such as the pistol, and another one on the end-users' body, as a backup magazine. Therefore, the end-user 100 may grab the backup magazine and use that just as a simple flashlight, such magazine may not include the bullet slots. In other words, the end-user 100 doesn't have to pull out their firearm 24 to illuminate an object or area which is clearly not a threat but they want to have better vision on in a little light situation. Further, in the event of a magazine change cause by running out of rounds or otherwise clearing a jam, the end user would have the prime illuminator 30 in the gun by way of inserting the second magazine. It should be noted the magazines 22 may be bullet slots that are filled with bullets just as a conventional magazine and the unit is adapted to be retrofitted to existing magazine bodies 22*b*. The light can actually be turned 'ON' in the holster by way of flicking the switch member 32 (or sliding switch 52 or pivoting switch 54) which may be upward into the rear and then withdrawn from one hand, one hand is only available to the end-user 100.

The throw of light can be between 30° to 160° in the lateral direction and approximately the same of the vertical direction. More preferred range would be between 90° and 120° of throw in the vertical and lateral directions. Also, the latest version is reasonably uniform when the user repositions from the compressed high ready to full presentation presenting the firearm 24 at a target amount of light variance is minimal on the target so not to distract the end user.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the present disclosure.

What is claimed is:

1. A magazine attached illuminating device for a firearm having a magazine, the magazine attached illuminating device comprising:

an illuminating device body configured to be attached on a bottom of the magazine, the illuminating device body having:

a slot; and an attaching cap to be detachably coupled to the illuminating device body, wherein the attaching cap, in entirety, is outside the slot, when the attaching cap is coupled to the illuminating device body;

a prime illuminator attached to a front end of the illuminating device body and a body of the prime illuminator extends in the slot to be removably disposed in the slot, wherein the body of the prime illuminator includes a power source disposed therein, the prime illuminator protrudes outwards from the illuminating device body, and is angled with respect to each of the illuminating device body and the attaching cap, the prime illuminator is configured to throw light on an object, the prime illuminator defines a center of throw of the light, and luminescent dispersion from the light; and a switch member attached to a rear end, opposite to the front end, of the illuminating device body to turn the magazine attached illuminating device on and off;

wherein the power source provided in the body of the prime illuminator to power the prime illuminator upon actuation of the switch member, and wherein a center throw of light from the prime illuminator is configured to be vertically lower from a bore axis extending longitudinally through a geometric center of a muzzle of the firearm.

2. The magazine attached illuminating device as claimed in claim 1, wherein, when the firearm is configured to be raised in a specific position or in a compressed specific position, the luminescent dispersion from the prime illuminator is configured to be pointing towards the object and the muzzle of the firearm is configured to be directed away from the object.

3. The magazine attached illuminating device as claimed in claim 1, wherein the illuminating device body comprises:

an attaching arrangement to detachably attach the magazine attached illuminating device to the bottom of the magazine, and a base region to be rounded and configured to not be extended beyond a specific position from a lower edge of the firearm to have a compressed and rounded corner, wherein the slot is defined between the attaching arrangement and the base region to removably receive the body of the prime illuminator.

4. The magazine attached illuminating device as claimed in claim 1, wherein the prime illuminator comprises Light Emitting Diodes (LED).

5. The magazine attached illuminating device as claimed in claim 1, wherein the throw of light is between 30° to 160° in a lateral direction and approximately the same as in a vertical direction, and more preferably, between 90° and 120° in the lateral and vertical directions.

6. The magazine attached illuminating device as claimed in claim 1, wherein the switch member comprises:

a switch, and a ridge coupled to the switch and operatively engages with the power source via a power circuit.

7. The magazine attached illuminating device as claimed in claim 6, wherein the switch is a sliding switch to be slid vertically downward and vertically upward to move the ridge, wherein the ridge is moved forward when the sliding switch is slid vertically upward to close the power circuit with the power source to turn on the prime illuminator, and wherein the ridge is moved backward when the sliding switch is slid vertically downward to disengage the power circuit with the power source to turn on the prime illuminator.

8. The magazine attached illuminating device as claimed in claim 6, wherein the switch is a pivoting switch to be rotated to a first orientation and to a second orientation to move the ridge, wherein the rotation enables the ridge to move forward to close the power circuit with the power source to turn on the prime illuminator, and to move backward to disengage the power circuit with the power source to turn on the prime illuminator.

9. The magazine attached illuminating device as claimed in claim 1, wherein the power source is a battery.

* * * * *